United States Patent [19]

Norman

[11] Patent Number: 5,038,812

[45] Date of Patent: Aug. 13, 1991

[54] QUICKLY ERECTABLE, QUICKLY COLLAPSIBLE, SELF SUPPORTING PORTABLE STRUCTURE

[75] Inventor: Lowell R. Norman, La Canada, Calif.

[73] Assignee: Spring Form, Inc., Pasadena, Calif.

[21] Appl. No.: 395,838

[22] Filed: Aug. 18, 1989

[51] Int. Cl.[5] ..... E04H 15/40

[52] U.S. Cl. ..... 135/104; 135/103; 135/106; 135/905

[58] Field of Search ..... 135/97, 103–106, 135/109, 905, DIG. 1

[56] References Cited

U.S. PATENT DOCUMENTS

| | | | |
|---|---|---|---|
| 3,675,667 | 7/1972 | Miller | 135/1 R |
| 3,960,161 | 6/1976 | Norman | 135/1 R |
| 3,990,463 | 11/1976 | Norman | 135/4 R |
| 4,815,784 | 3/1989 | Zheng | 296/97.7 |
| 4,825,892 | 5/1989 | Norman | 135/104 |
| 4,858,634 | 8/1989 | McLeese | 135/104 |
| 4,951,333 | 8/1990 | Kaiser et al. | 135/104 X |

FOREIGN PATENT DOCUMENTS

| | | | |
|---|---|---|---|
| 2635136 | 2/1990 | France | 135/106 |

*Primary Examiner*—David A. Scherbel
*Assistant Examiner*—Lan Mai
*Attorney, Agent, or Firm*—F. Eugene Logan

[57] ABSTRACT

Quickly erectable, quickly collapsible, self supporting portable structures (100) that are self expandable with little or no effort by the user, which in their fully expanded upstanding configuration are self supporting. The fully expanded upstanding structure can be quickly collapsed into a stack of side members (145) and then coiled into a pack (160) with little effort by the user. The structures can be used as tents, shelters, pavilions and automobile carports. In general the portable structures have a set of at least three side members (102) each having a flexible frame (106), a side panel (108), a pocket (110) joined to the panel by stitching (112). The frame causes the side members to be self expandable. Side members are hinged together by stitching (130). A floor member (104) sewn to the bottom (124) of each side member holds the structure in the upstanding position.

22 Claims, 13 Drawing Sheets

FIG. 5
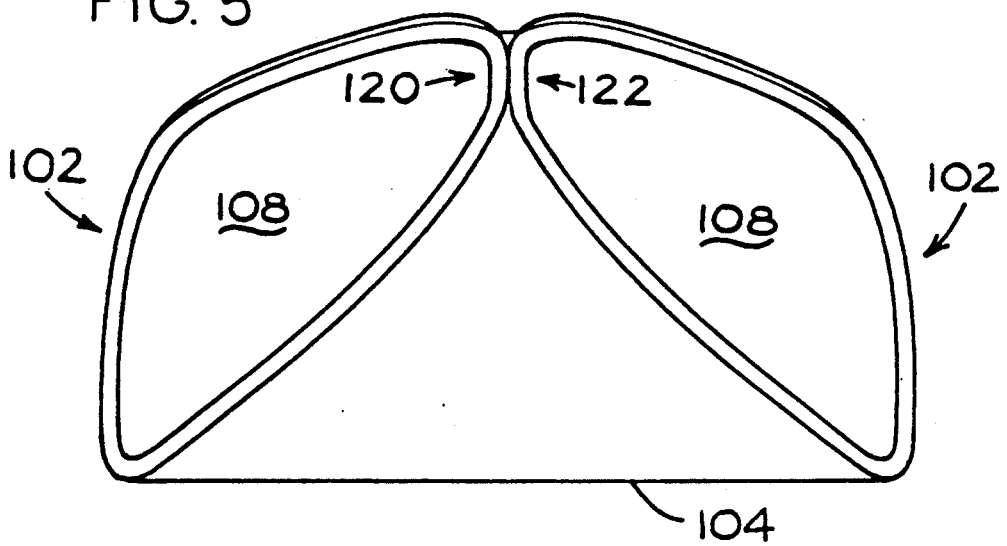
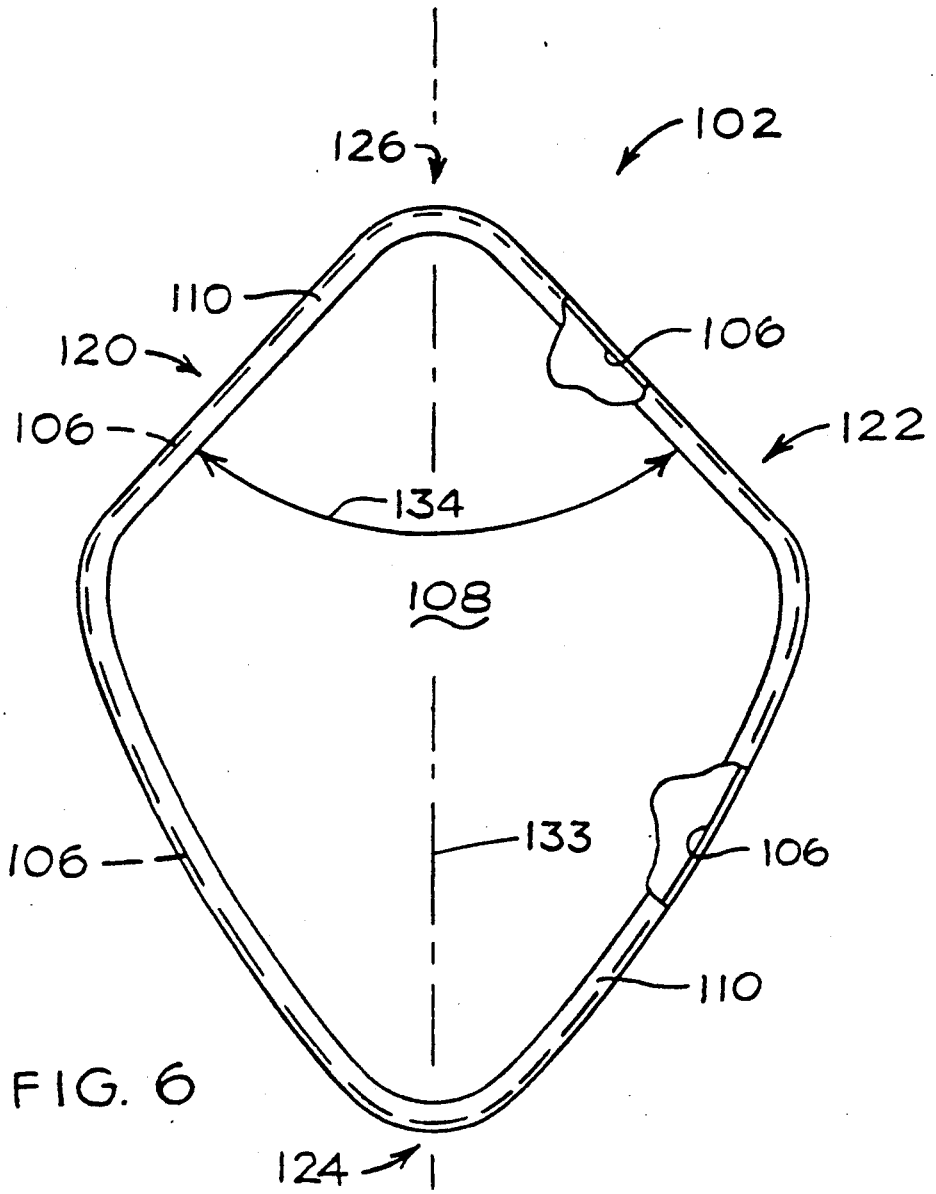
FIG. 6

FIG. 7
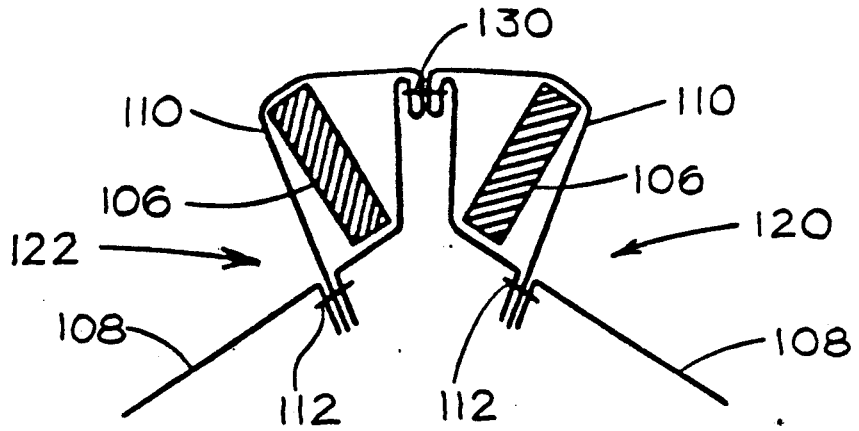
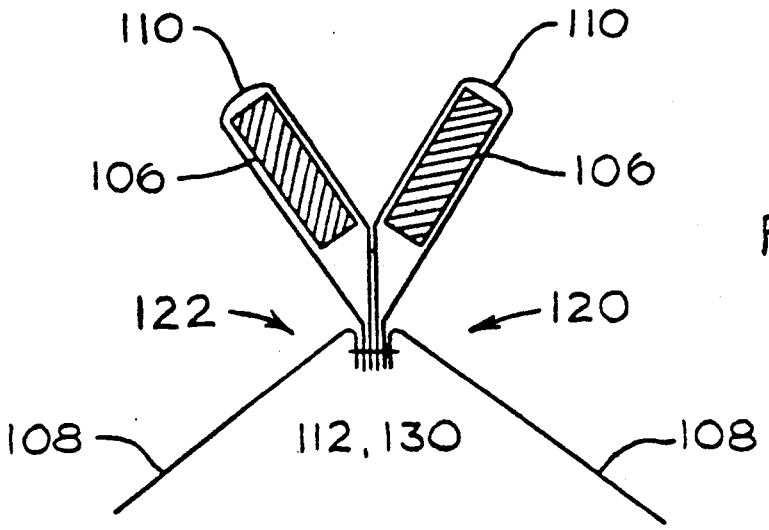
FIG. 8
FIG. 9
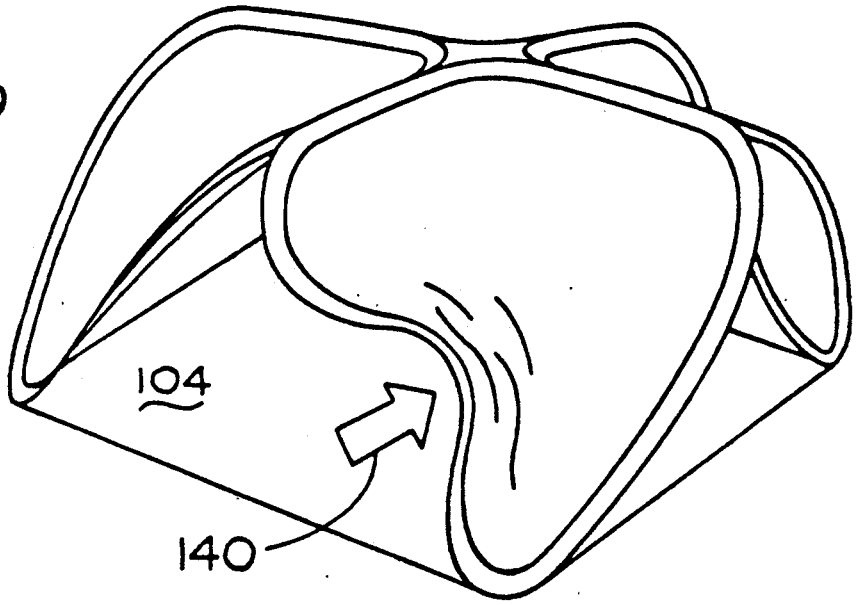

FIG. 12
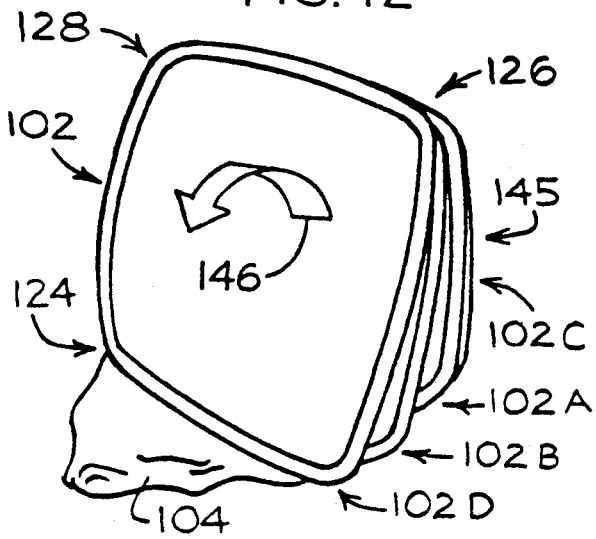
FIG. 13
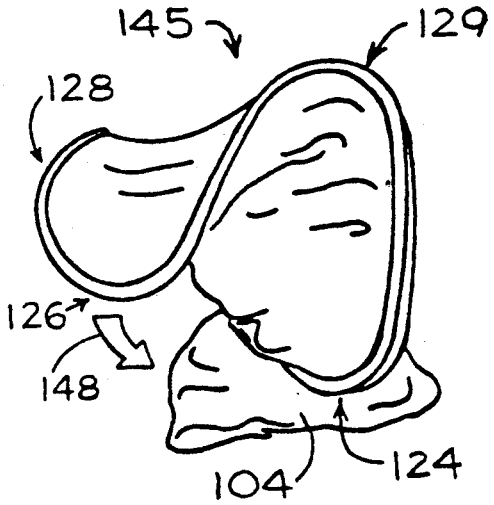
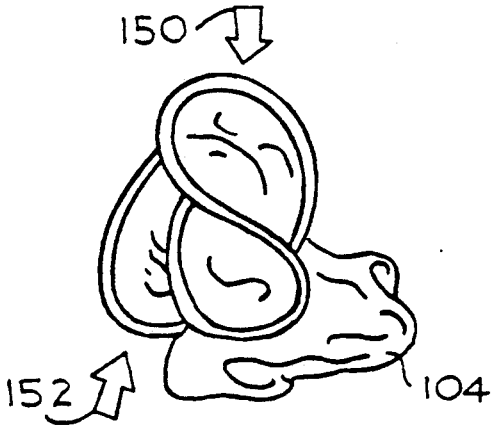
FIG. 14
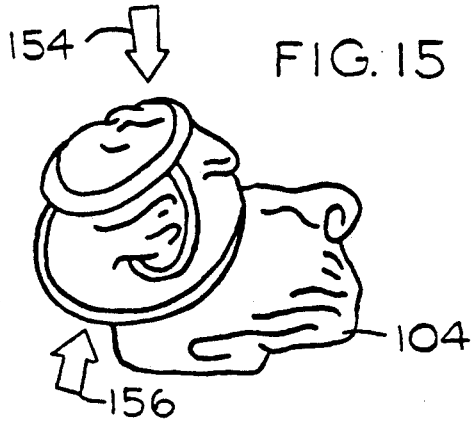
FIG. 15
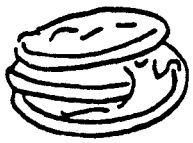
FIG. 16
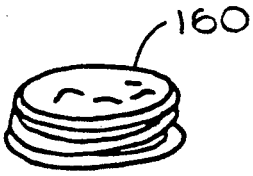
FIG. 17

FIG. 18
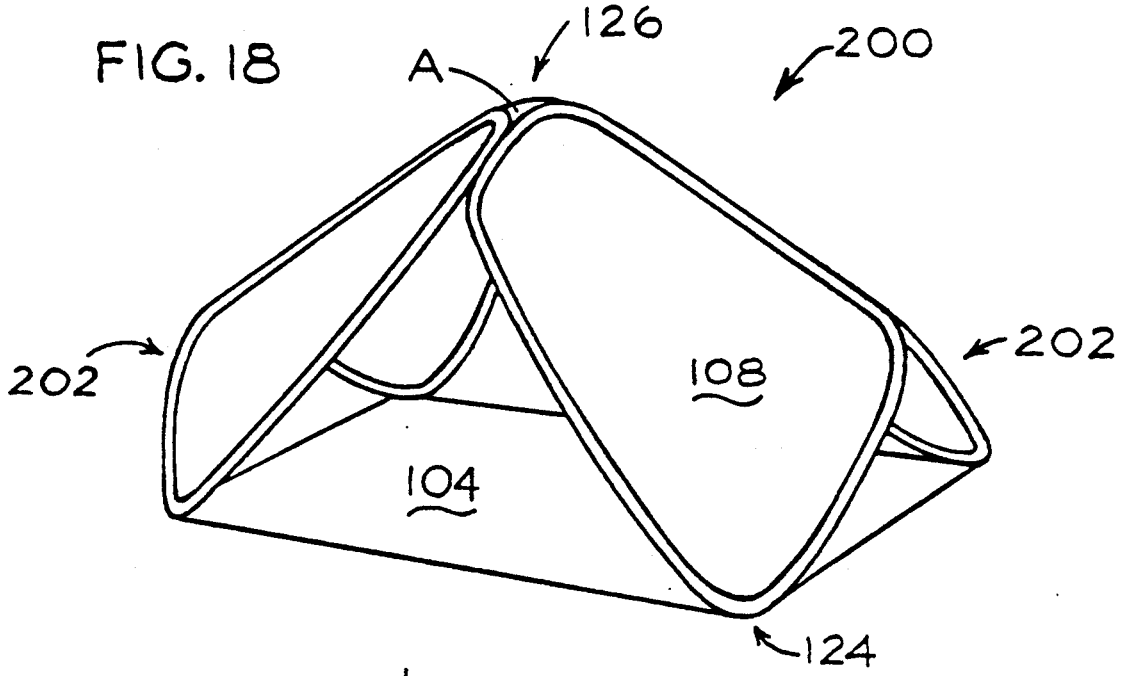
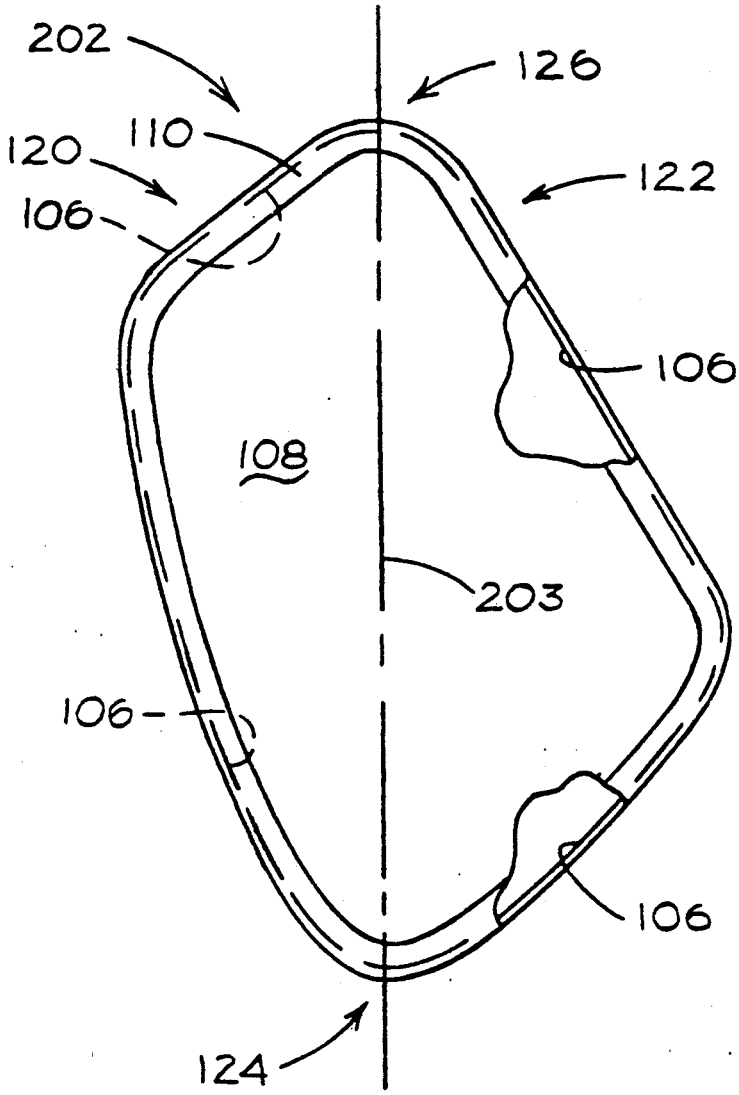
FIG. 19

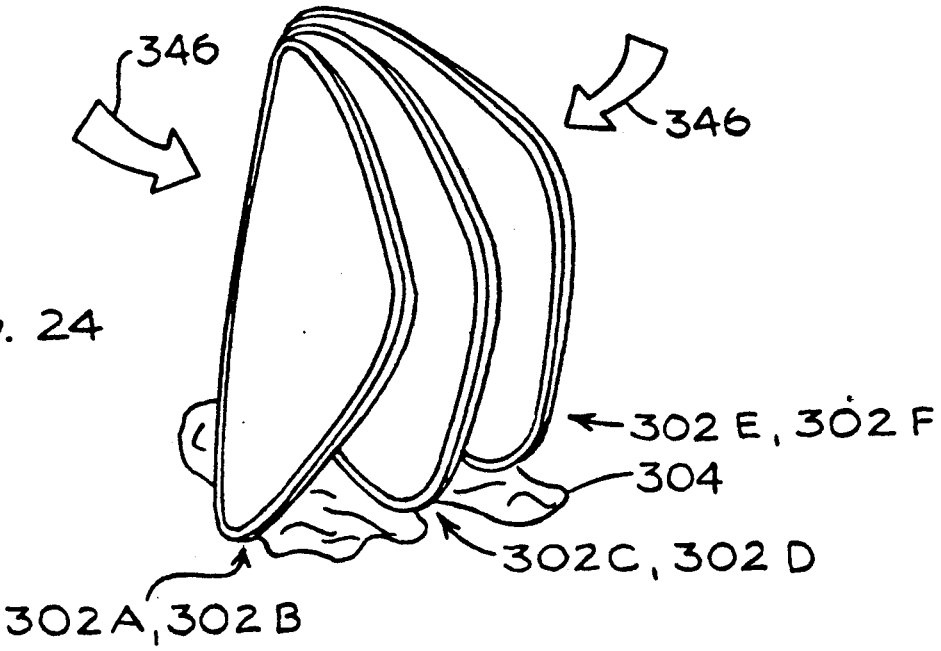
FIG. 24
FIG. 25
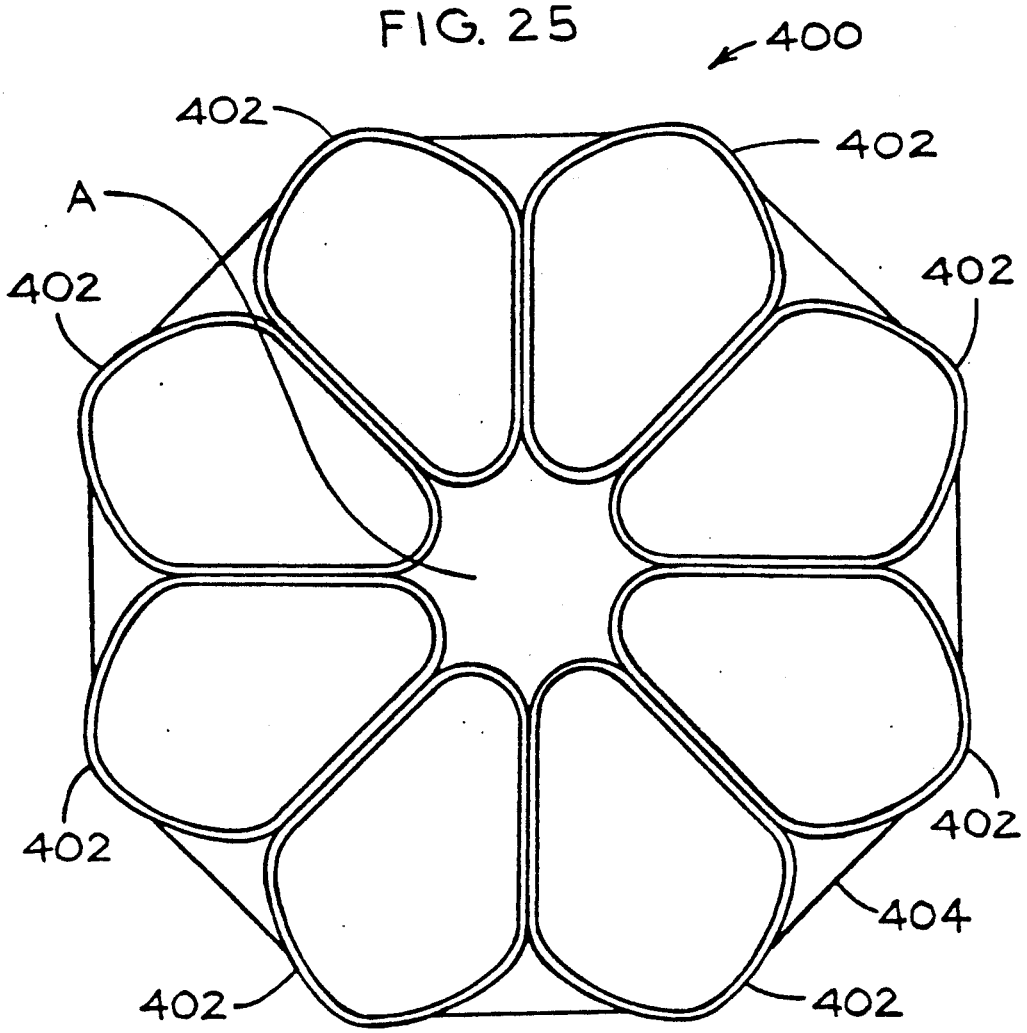

FIG. 28
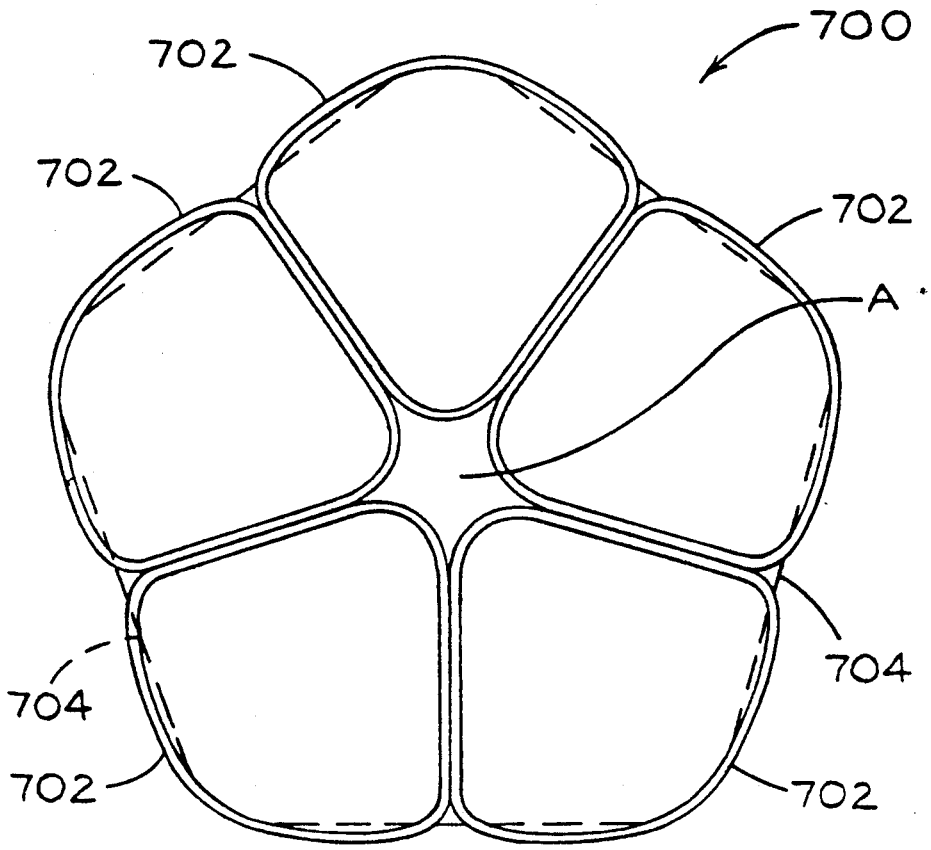
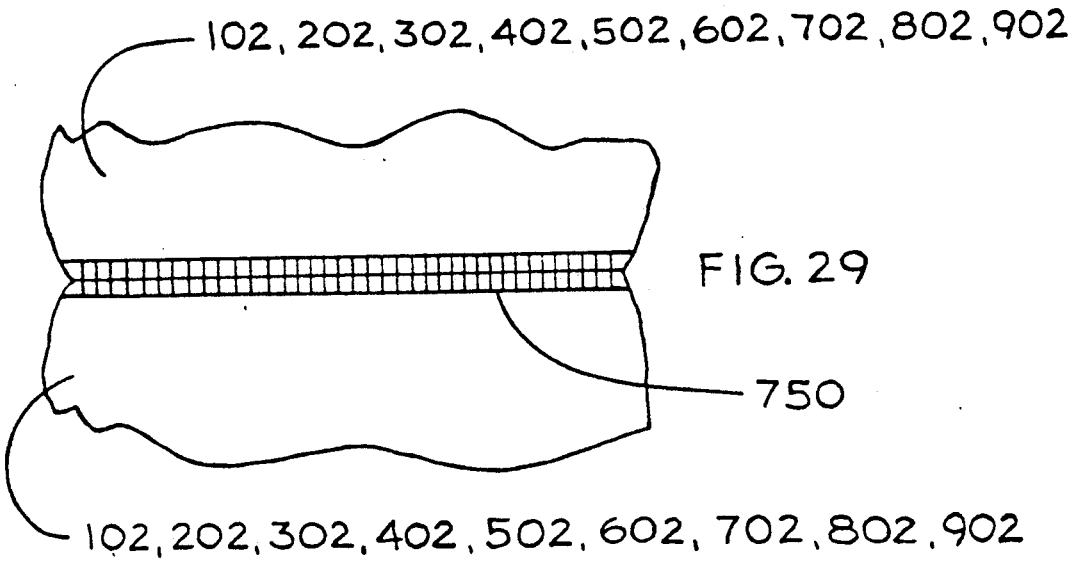
FIG. 29

QUICKLY ERECTABLE, QUICKLY COLLAPSIBLE, SELF SUPPORTING PORTABLE STRUCTURE

TECHNICAL FIELD

This invention is concerned with portable structures and in particular portable structures which are at least partially self erectable or self expandable and which can be quickly erected and quickly collapsed.

BACKGROUND ART

Tent and tent-like structures which are light weight and easily erectable and quickly collapsible are known. U.S. Pat. No. 3,675,667 discloses a tent of the type generally referred to as quickly erecting or self erecting which can be folded down without taking its components apart.

U.S. Pat. No. 3,960,161 to Norman discloses a tent having a frame comprising a loop or loops of flexible material which can be coiled during collapsing to a small compact pack. The structure generally requires staking to maintain it in the fully expanded upstanding configuration.

U.S. Pat. No. 3,990,463 to Norman discloses another portable structure which comprises a fabric shell that forms various outer surfaces of the erected structure and a frame generally having a figure-eight configuration when expanded. Larger structures having two figure-eight frames are also disclosed. The single figure-eight frame structure has a tendency to roll and generally requires staking to be stable.

U.S. Pat. No. 4,825,892 to Norman discloses a portable structure with a frame which has a figure-eight configuration having straight portions which prevent the portable structure from rolling over when fully expanded and upstanding. All of the above mentioned portable structures are of the self erecting or self expandable type, that is, the structures will when uncoiled at least partially spring out to their expanded configuration with little or no effort from the user.

U.S. Pat. No. 4,815,784 discloses an automobile sunshield having collapsible flexible loop members.

SUMMARY OF THE INVENTION

An object of the present invention is to provide an improved, portable structure which can be easily transformed between a fully expanded and a fully collapsed configuration.

Another object is to provide an improved, portable structure which when fully expanded or erected is self supporting.

Still another objective of this invention is to provide a portable structure which can be collapsed to a relatively small pack.

Yet another object is to provide a portable structure which is lightweight and can be easily carried for long distances by and erected and collapsed by one individual.

Another object is to provide a portable structure which does not require stakes loops and stakes and similar devices to be self supporting when in its fully expanded configuration.

Another objective of this invention is to provide a portable structure which can be fan-folded or compressed in accordion-like fashion into a stack of overlaying side members and further in which the stack can then be coiled into a relatively small pack.

Accordingly, there is provided by the principals of this invention a portable structure operable for transformining from a fully collapsible configuration into an upstanding fully expanded configuration and thence back into the fully collapsible configuration comprising

- a set of at least three side members each having
  - an independent continuous frame formed from a flexible coilable material, the frame forming a single loop when expanded, and three overlaying loops when collapsed;
  - a side panel formed from a foldable material;
  - confining means or first means for confining the frame, the confining means having a top left part and a top right part; and
  - attaching means or second means for attaching the side panel to the confining means, whereby when the frame is expanded the side panel is pulled taut by the frame;
- hinging means or third means for hinging a portion of the top right part of the confining means of one side member to a portion of the top left part of the confining means of one other side member, thereby forming when the portable structure is in its fully expanded configuration a ring of side members each hinged at the top left part to another side member and at the top right part to yet another side member; and
- holding means or fourth means for holding the portable structure in the upstanding fully expanded configuration.

In one embodiment of this invention each side member has a bottom part intended for resting on a horizontal surface when the portable structure is fully expanded.

In another embodiment each of the side member is self expandable.

In one embodiment of this invention the number of side members of the portable structure is an even number. In another embodiment the number of side members is 4; in still another embodiment the number of side members is 6; and in yet another embodiment the number of side members is 8.

In one embodiment of this invention the number of side members of the portable structure is an odd number. In another embodiment the number of side members is 3; and in still another embodiment the number of side members is 5.

In one embodiment of this invention the confining means allows the frame to slide in the confining means. In one embodiment the confining means is a pocket formed from a foldable material and the pocket is operable for slidably confining the frame.

In one embodiment of this invention the attaching means of the portable structure is stitching.

In one embodiment of this invention the hinging means of the portable structure is stitching. In another embodiment the hinging means remains hinged during transforming from the fully collapsible configuration into the upstanding fully expanded configuration and thence back into the fully collapsible configuration, i.e. the hinging means remains hinged at all times to its pair of side members.

In one embodiment of this invention the hinging means is operable for folding the side members over each other thereby forming a stack of overlaying side members, and the flexible coilable material of the frame is operable for simultaneously coiling of the thusly formed stack into three overlaying loops. In a further embodiment the hinging means is for permitting folding of each side member over another side member of the set of side members while hinged together.

In one embodiment of this invention the hinging means of the portable structure can be unhinged for one pair of adjacent side members.

In one embodiment of this invention the holding means is for maintaining the bottom part of the side members in a predetermined horizontal spatial orientation. In another embodiment the holding means includes a floor panel member formed from a foldable material, and the bottom part of each of the side members is connected, preferably by stitching, to the floor panel member. In still another embodiment the holding means is a set of straps connecting adjacent side members which restrains the separation thereof. In a further embodiment the straps are connected below the hinge means.

In one embodiment of this invention the holding means is for restraining each side member, for stabilizing the portable structure and for maintaining it in the upstanding fully expanded configuration.

In one embodiment of this invention a part of each of the side members is connected by stitching to the holding means or floor panel member or straps.

In one embodiment of this invention, the flexible coilable frame has a cross-section the width of which is at least about two times larger than its thickness and preferably at least about four times larger than its thickness.

In general, the frame is formed from material which is relatively strong but nevertheless flexible enough to allow it to be coiled. The frame material should be resilient and preferably anisotropic; e.g. by being asymmetric about its longitudinal axis. In one embodiment of this invention, the frame material is flat spring steel stock. The size of the frame will dependent on the size of the portable structure which the expanded frame must support. For most sizes of the structures of this invention which use flat spring steel stock, a width from about 1.6 mm (0.0625 inches) to about 76 mm (3 inches), and a thickness from about 0.51 mm (0.020 inches) to about 5.1 mm (0.200 inches) will be adequate. For structures intended to be use around water or at the beach the material of the frame is preferably stainless steel or plated or coated spring steel stock for corrosion resistance. Other frame materials which may be employed include plastic materials having a relatively high bending moduli of elasticity which are in the shape of a flat strip or an oval shaped tube. Round or square shaped tubing or solid stock can also be employed for frame, however, because such shapes are isotropic they are not preferred. The ends of the frame stock can be secured together by any means including overlapping the ends and fastening with a rivet, clamp, bracket, connector or adhesive.

In one embodiment the material for the frame is flat spring steel stock having a thickness of approximately 1.25 mm (0.050 inches) and a width of approximately 12.5 mm (0.500 inches).

Each of the side members include a compression means for shaping the expanded frame of each side member into a predetermine configuration. In general side panel are used as frame compression means and are connected under tension to the frame. In one embodiment the frame is connected to the side panel by elongated, tubularly shaped pockets which project outwardly from the structure's foldable cloth-like body or side panel. Thus when the structure is erected, the elongated pockets containing the frame extends outwardly from the structure's side panels.

The preferred foldable cloth-like materials for forming the side panels, pockets and floor member of this invention are materials commonly used in fabricating tents and other portable structures. Non-limiting examples of such foldable materials are those made from plastic fibers produced by E. I. Du Pont de Nemours and sold under the trademark Nylon and Dacron, both of which are preferred materials of construction.

BRIEF DESCRIPTION OF THE DRAWINGS

FIG. 5 is an elevational view in cross-section taken through line 5—5 of FIG. 3, the elevational view in cross-section taken through line 5A—5A being identical.

FIG. 6 is a top plan view of an expanded single symmetrical side member of embodiment 100 before it is assembled with other side members.

FIG. 7 is a detail in cross-section taken through line 7—7 of FIG. 2 of one embodiment of two pockets holding the frames of two adjacent side members, of a hinge formed by stitching, and of a method of joining side panels to pockets by stitching.

FIG. 8 is a detail in cross-sectional view taken through line 8—8 of FIG. 2 of another embodiment of this invention of two pockets holding the frames of two adjacent side members, of another method of joining side panels to pockets, and a method of forming a hinge by stitching.

FIG. 9 is a top, front and right side perspective view of the portable structure of FIG. 1, showing an initial stage of its collapse.

FIG. 12 is a perspective view of the structure of FIG. 11 with two side members folded over two other side members and forming a stack of four side members.

FIG. 13 is a perspective view of the stack of four side members of FIG. 12 with opposing corners bent towards each other.

FIG. 14 shows a further stage of collapse from FIG. 13.

FIG. 15 shows a further stage of collapse from FIG. 14.

FIG. 16 shows a further stage of collapse from FIG. 15.

FIG. 17 shows the fully collapsed configuration of the portable structure of FIG. 1.

FIG. 18 is a top, front and right side perspective view of a second embodiment of the portable structure of this invention with non-symmetrical side members and larger openings in the front and back than in the left and right sides.

FIG. 19 top plan view of an expanded single non-symmetrical side member of FIG. 18 before it is assembled with other side members.

FIG. 24 is the portable structure of FIG. 23 showing a still further stage of collapse.

FIG. 25 is a top plan view of a fourth embodiment of the portable structure of this invention with eight side members.

FIG. 28 is a top plan view of a seventh embodiment of the portable structure of this invention with five side members.

FIG. 29 is a detail of a hinge which can be unhinged.

BEST MODES FOR CARRYING OUT THE INVENTION

Figure 1:
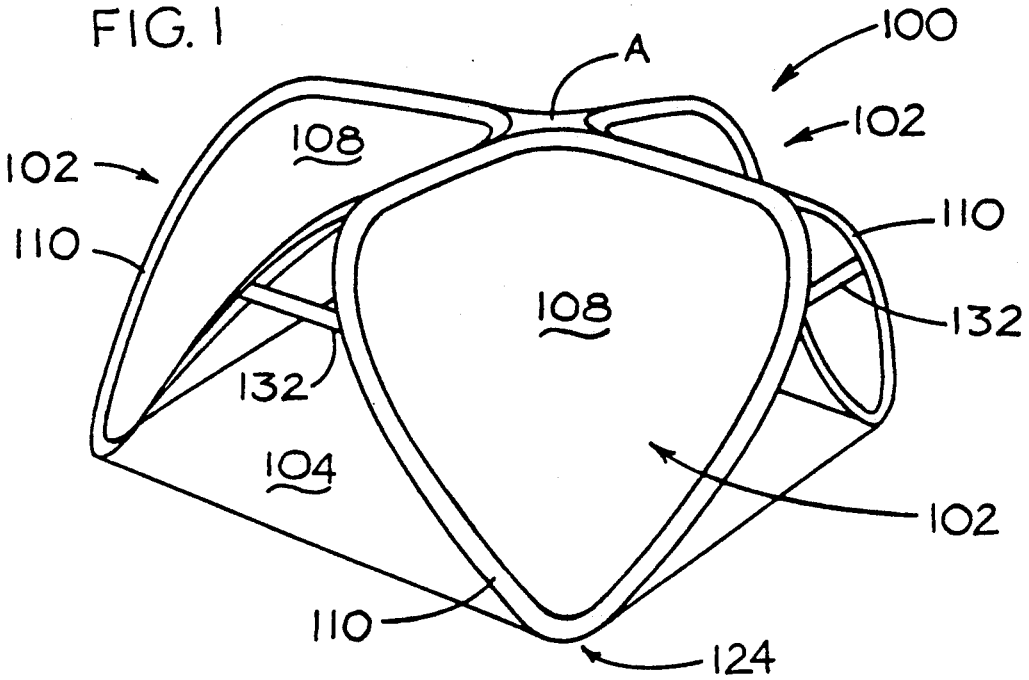
FIG. 1 is a top, front and righ perspective view of one embodiment of the portable structure of this invention having four side members.

The general principals of the quickly erectable, quickly collapsible, self supporting portable structure of this invention are shown in the figures of which FIG. 1 is a top, front and right side perspective view of one embodiment of this invention generally designated by numeral 100 which has a set of four side members 102 and floor panel or member 104.

Figure 2:
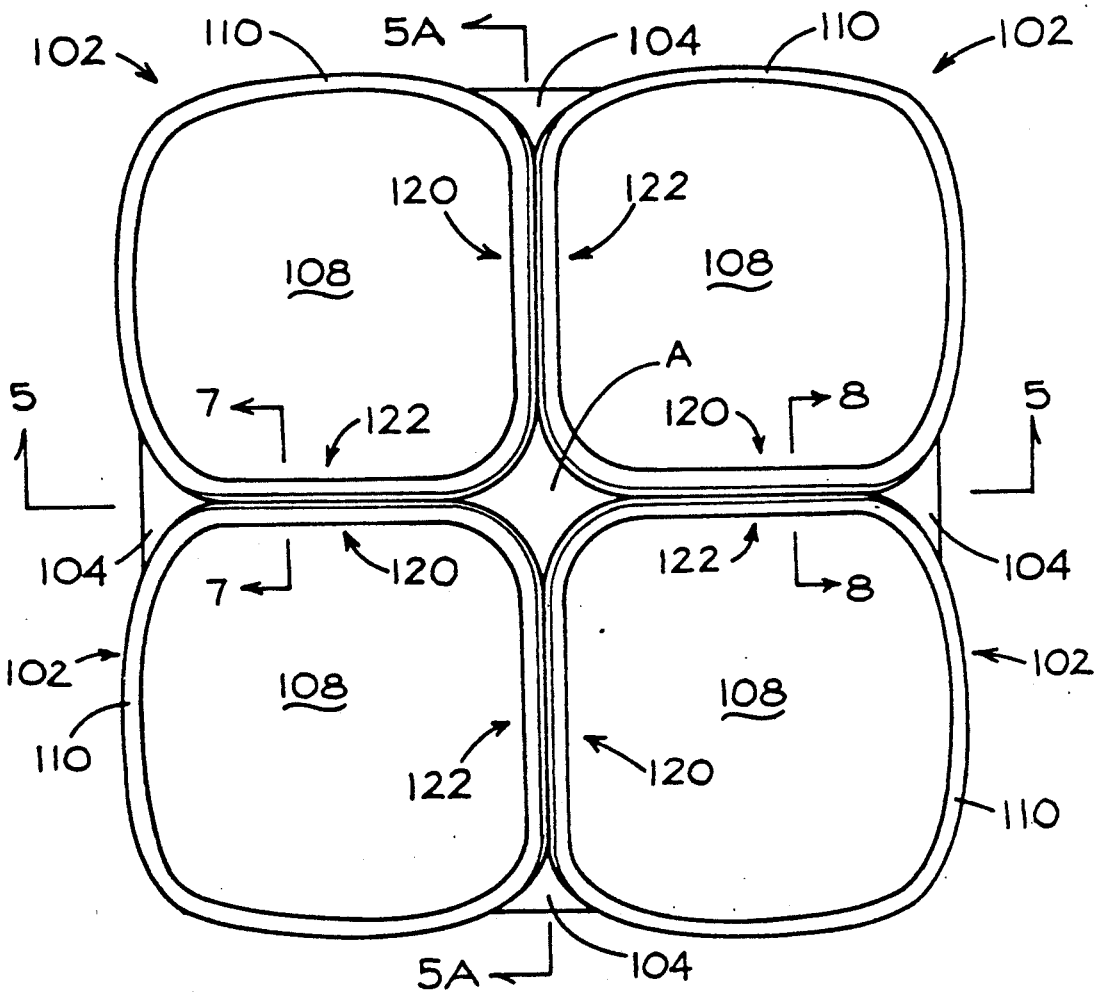
FIG. 2 is a top plan view of the structure of FIG. 1.
Figure 3:
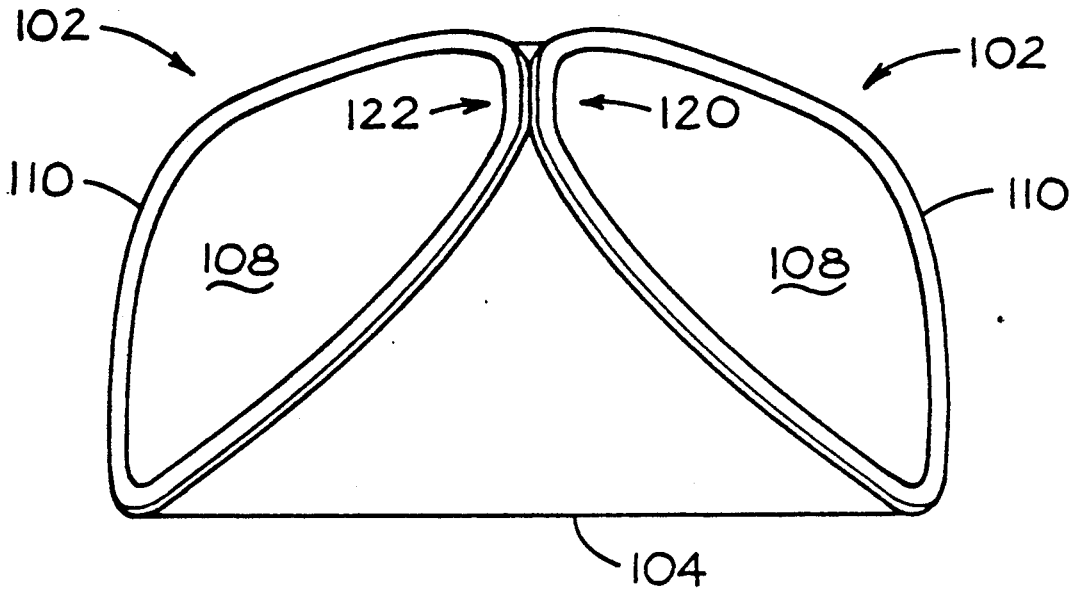
FIG. 3 is a front elevational view of the structure of FIG. 1, the rear, left side and right side views being identical.
Figure 4:
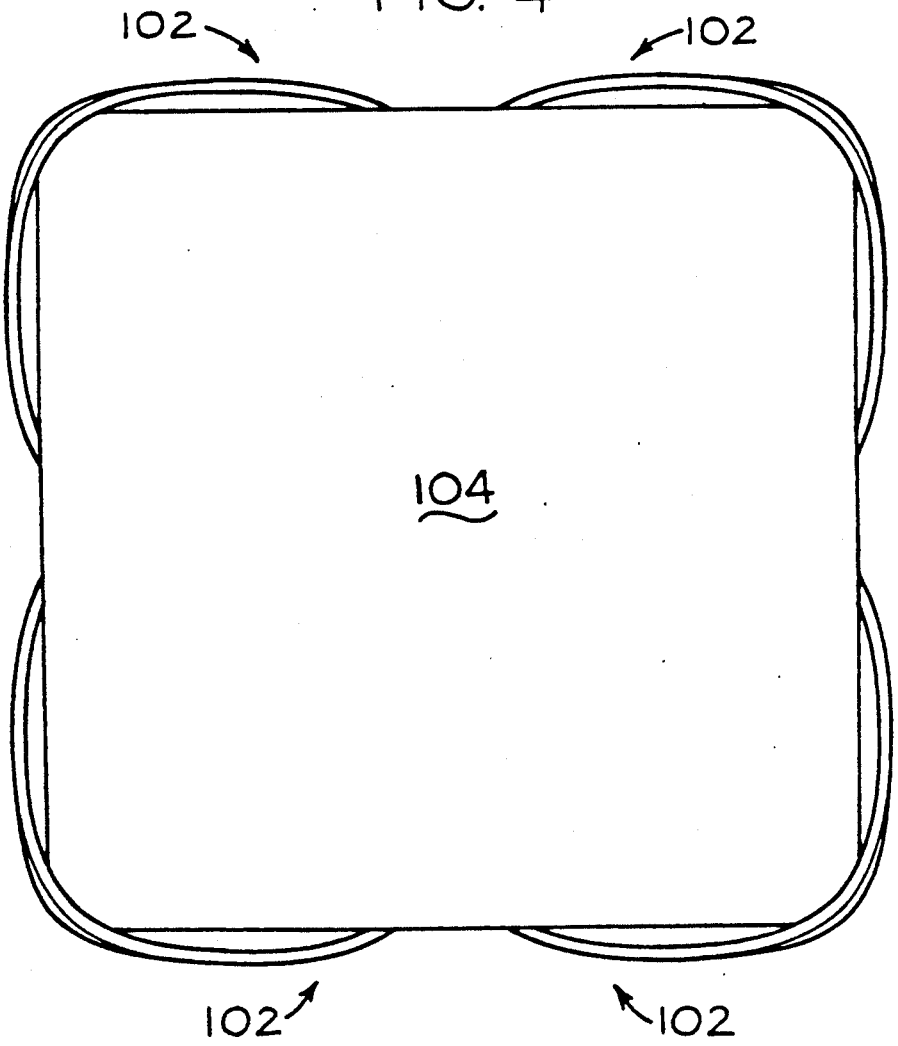
FIG. 4 is a bottom plan view of the structure of FIG. 1.

FIG. 2 is a top plan view of the structure of FIG. 1. In this embodiment the four side members 102 are identical as can be seen in FIG. 2. FIG. 3 is a front elevational view of embodiment 100. Since the side members are also symmetrical, the rear, right side and left side elevational views are identical to FIG. 3. FIG. 4 is a bottom plan view of embodiment 100.

Details of the construction are shown in FIG. 5 which is an elevational cross-sectional view taken through line 5—5 of FIG. 2. Since embodiment 100 is symmetrical the elevational cross-sectional view taken through line 5A—5A is identical to FIG. 5.

Further details of the construction are shown in FIGS. 6 to 8. FIG. 6 is a top plan view of a single side member, 102, of embodiment 100 before the side member is assembled in the finished portable structure. Side member 102 comprises an independent continuous self expandable frame, 106, and a side panel, 108, formed from a foldable material. Frame 106 is slidably contained in pocket 110 thereby providing means for confining frame 106. The pocket is formed from a foldable material. Pocket 110 therefore provides means for confining frame 106 in slidable relationship to pocket 110. In one embodiment pocket 110 is attached to side panel 108 by stitching 112 as seen best in FIGS. 7 and 8. Stitching 112 therefore provides means for attaching side panel 108 to pocket 110. In one embodiment pocket 110 is continuous and bounds the entire circumference of side panel 108.

Frame 106 is formed from a flexible coilable material. Non-limiting examples of flexible coilable material suitable for the frame are steel or plastic strip. Preferably the frame has a rectangular cross-section which facilitates both the self expendability of side member 102 and the coilability of the frame, which in turn facilitates the collapsibility of the finished portable structure into overlaying loop assemblages or loops. In one embodiment frame 106 is made from flat stainless steel stock having a thickness of about 1.25 millimeters and a width of about 12.5 millimeters. Due to the self expendability of frame 106, side panel 108 is pulled taut by frame 106 and in one embodiment has a saddle-like curvature.

Side member 102 and more particularly pocket 110 thereof has a top left part 120, a top right part 122, a bottom part 124 and a top part 126 which is best seen in FIG. 6. Stitching 130 attaches and hinges a portion of the top right part 122 of pocket 110 of one side member to a portion of the top left part 120 of the pocket of another and adjacent side member as seen best in FIGS. 7 and 8. Stitching 130 provides means for hinging the side members together. When the portable structure is in its fully expanded configuration stitching 130 enables a ring of side members to be formed such that each side member is hinged at the top left part 120 to another side member and at the top right part 122 to yet another side member as best seen in FIGS. 2 and 3. Stitching 130 provides means for permitting folding of each side member over another side member and for transforming the portable structure into a stack of overlaying side members.

FIG. 7 depicts a method of joining and hinging a portion of adjacent pockets 110 together with stitching 130. Separate stitching 112 depicts a method of joining pockets 110 to side panels 108. FIG. 8 depicts an alternate method of joining two adjacent side panels 108 and two adjacent pockets 110 simultaneously with one row or set of stitching that also provides means for hinging side members 102 together. Either the method in FIG. 7 or FIG. 8 can be used in this invention. Other methods of joining the side panels to the pockets and hinging the side members together can also be used if desired.

In order for the fully expanded configuration to remain upstanding, means must be provided which prevents the bottom parts 124 of side members 108 from merely stretching out so that all side members 102 lie approximately in, or almost in, the same horizontal plane. In embodiment 100 this is accomplished by floor member 104 which is attached to bottom part 124 of each side member 102. Floor member 104 therefore provides means for holding the fully expanded configuration portable structure in the upstanding fully expanded configuration.

Alternative means for holding the expanded structure in the upstanding configuration are straps 132 which span and connected adjacent side members 102 or pockets 110 thereof together. Straps 132 are attached to pockets 110 below the hinge area or stitching 130. In one embodiment (not shown) such straps span and connect bottom parts together. It should be understood, however, that straps 132 are not required if floor member 104 is provided; and, that floor member 104 is not required if straps 132 are provided. Straps 132 are illustrated only in FIG. 1.

Pocket 110 additionally provides means for allowing frame 106 to slide relative to the pocket. By allowing frame 106 to slide in pocket 110, stress and strain on pocket 110 and side panel 108 are reduced thereby increasing the useful life of the structure and reducing repair cost.

It is to be understood that although side panels 108 and floor members 104 are shown by a line without thickness in FIGS. 3, 5, 7 and 8, the side panels and floor members of this invention are made from a foldable or cloth-like material which, of course, does have thickness.

Figure 10:
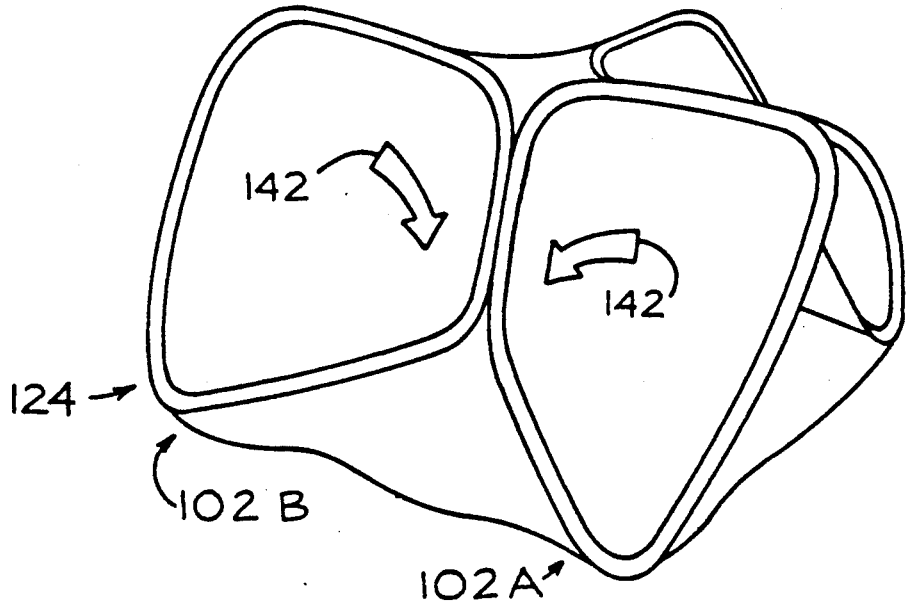
FIG. 10 is a top, front and right side perspective view of the structure of FIG. 9, showing a further stage of collapse.
Figure 11:
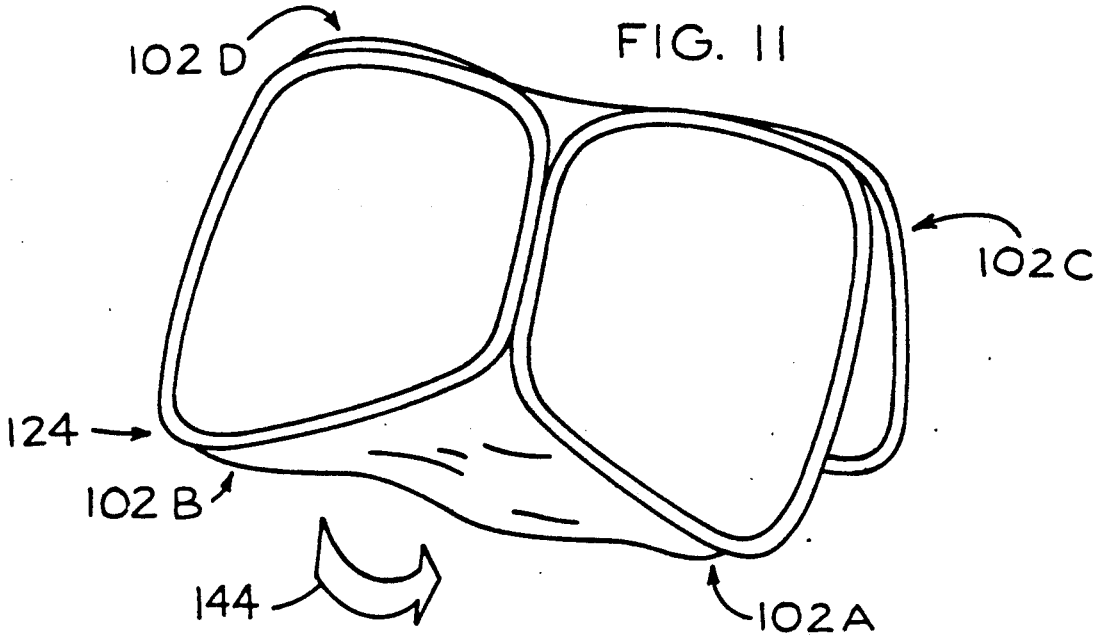
FIG. 11 is a top, front and right side perspective view of the structure of FIG. 10, showing a further stage of collapse.

FIGS. 9 to 17 show various stages of collapse of the portable structure of embodiment 100. Collapsing of the structure beings by pushing the sides of the frame of one side member inwardly in the direction of arrow 140, FIG. 9, which results in a buckling of that member until it and an adjacent member automatically spring inwardly as shown in FIG. 10. Next inwardly directed side members 102A and 102B are pushed further inward in direction of arrows 142 until they overlay the other two rearward facing side members 102C and 102D as shown in FIG. 11.

Next the structure is folded left to right over itself in the direction of arrow 144 until the four side members overlay each other as seen in FIG. 12. In FIG. 12 although the structure is partly collapsed each side member is still fully expanded. If desired the portable structure can be transported in this configuration which is fairly flat; however, further collapse to a fully collapsed configuration of approximately one-third the diameter or span of FIG. 12 is possible as will be explained. It will be noticed that floor member 104 trails from bottom part 124 of each side member. If it is desirable to transport the portable structure at this stage of collapse, floor material 104 can be conveniently tucked in between any of side members 102.

At this stage of collapse a stack, 145, of four overlaying side members is formed. FIGS. 13 to 17 show the final stages of collapse into three overlaying loop assemblages or loops. First the overlaying top parts 126 of stack 145 of overlaying side members are curled downward in the direction of arrow 146 towards overlaying bottom parts 124 as shown in FIG. 13. Top parts 126 of stack 145 are then curled even more in direction of arrow 148 until corners 128 and 129 of stack 145 automatically spring inwardly as shown in FIG. 14, which depicts an early stage of the formation of three overlaying loop assemblages or loops. Next stack 145 is compressed in the direction of arrows 150 and 152 until the three loops are more developed as shown in FIG. 15. At this point the trailing floor member 104 can be tucked between the thusly formed three loops and the stack further compressed in the direction of arrows 154 and 156 until the structure resembles that of FIG. 16. Further compression of the structure produced a layered, pancake-like structure or pack 160 of three overlaying coiled loops formed from stack 145 as shown in FIG. 17. The diameter or span of the fully collapsed portable structure of FIG. 17 is approximately one-third of the diameter or span of stack 145 of FIG. 12.

A second embodiment of this invention, generally designated by numeral 200 is shown in FIG. 18. FIG. 18 is a top, front and right perspective view of embodiment 200 which is a structure having four side members. However, side members 202 are not symmetrical as they were in embodiment 100. Rather in embodiment 200 side members 202 are skewed about axis 203 as shown in FIG. 19 which is a top plan view of a single side member 202 before it is assembled in the finished portable structure.

Side members 202 are hinged together in a similar manner as in embodiment 100, however, each side member is hinged to side members which are its mirror image thereby causing the fully expanded configuration structure to have a higher opening or doorway in the front and rear than on the left and right sides. This embodiment of alternating "member/mirror-image member/member/mirror-image member" is useful for structures having an even number of side panels.

Figure 20:
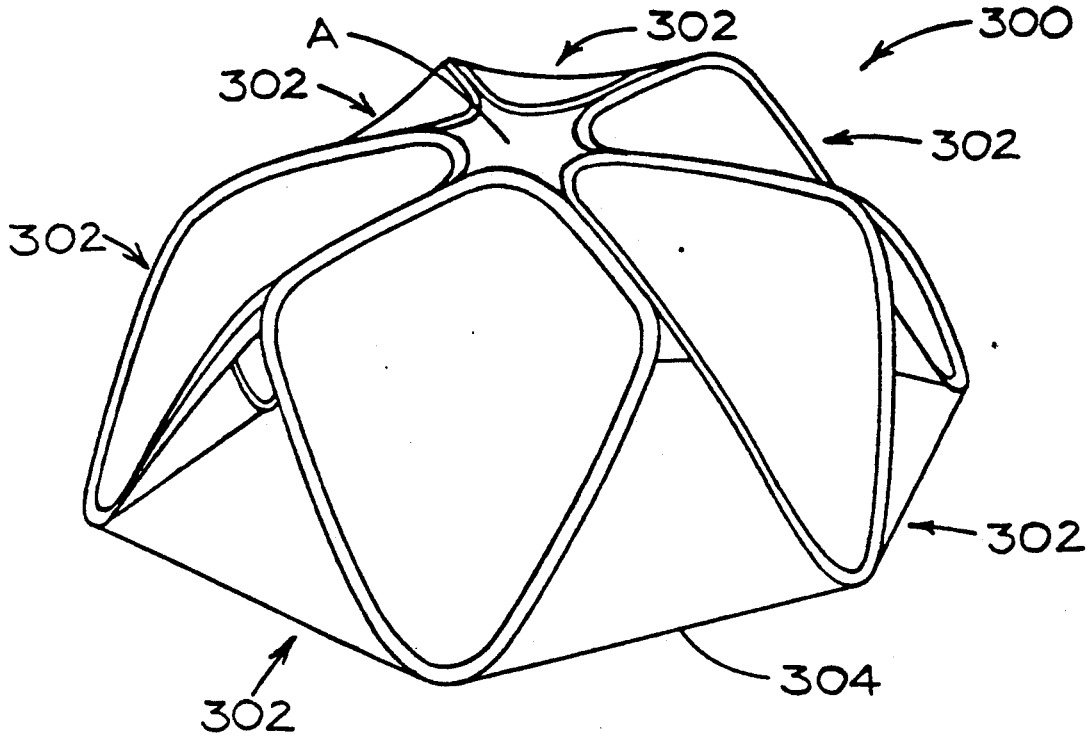
FIG. 20 is a top, front and right side perspective view of a third embodiment of the portable structure of this invention having six side members.
Figure 21:
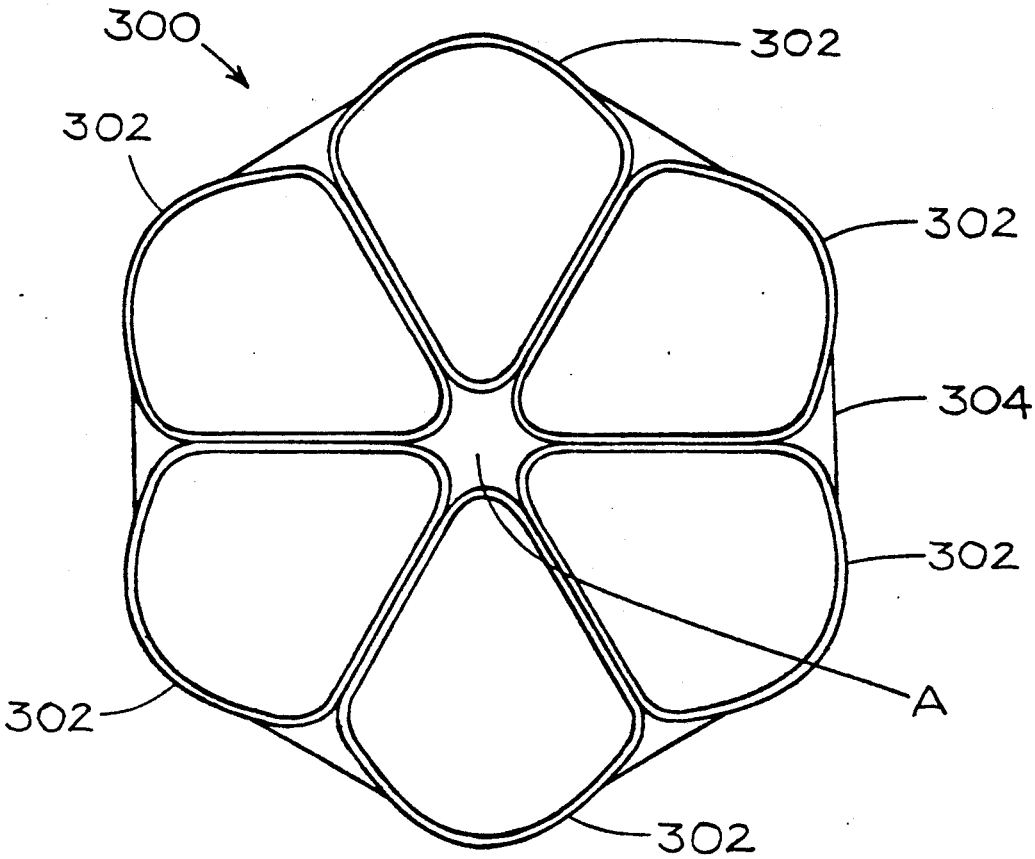
FIG. 21 is a top plan view of the structure of FIG. 20.
Figure 22:
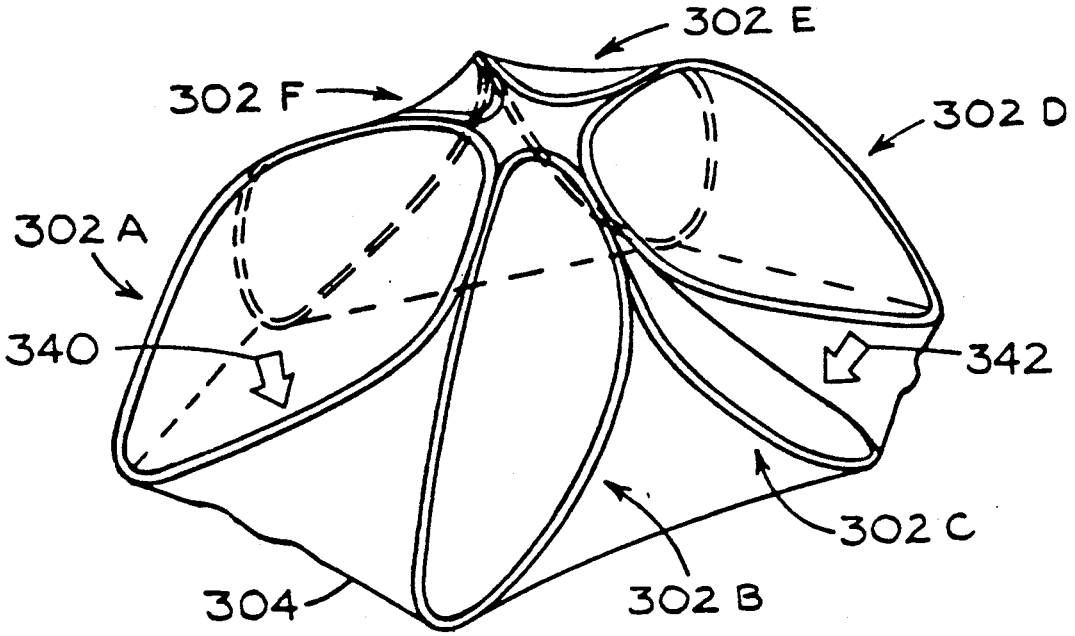
FIG. 22 is a top, front and right side perspective view of the portable structure of FIG. 20, showing an initial stage of collapse.

FIG. 20 shows still another embodiment, generally designated by numeral 300, of the portable structure of this invention having six side members 302 and floor member 304. FIG. 21 is a top plan view of embodiment 300. Embodiment 300 can be collapsed to form a stack of six overlaying side members in a manner similar to the formation of stack 145, FIG. 12, for embodiment 100. In particular, as shown in FIG. 22, collapsing begins by pushing the side of the frame of side member 302A inward in the direction of arrow 340 until side members 302A and 302B automatically spring inward. Then the side of the frame of side member 302C is pushed inward in the direction of arrow 342 until side members 302C and 302D automatically spring inward. At this stage of initial collapse the structure looks like FIG. 22 with four of the six side members deployed inwardly.

Figure 23:
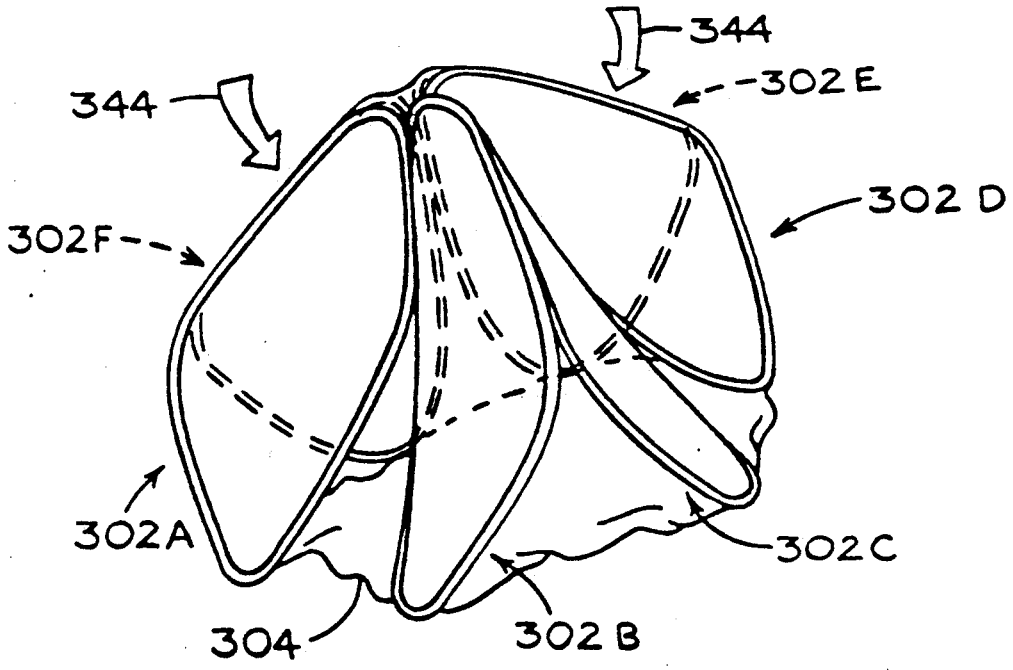
FIG. 23 is the portable structure of FIG. 22 showing a further stage of collapse.

Next the six side members are folded together in accordion-like manner by pushing and folding side members 302E and 302F together in the direction of arrows 344 of FIG. 23 thereby collapsing the structure further until it reaches the stage of collapse shown in FIG. 24. Further fan-folding of the structure in the direction of arrows 346 produces a completely folded stack of six overlaying side members similar stack 145 of FIG. 12. The stack of six overlaying side members is then transformed into three overlaying loop assemblages or loops in a manner identical to the coiling of stack 145 for embodiment 100 as shown in FIGS. 13 to 17.

FIG. 25 shows a top plan view of yet another embodiment, generally designated by numeral 400, of the portable structure of this invention, characterized by having eight side members 402 and floor members 404.

Figure 26:
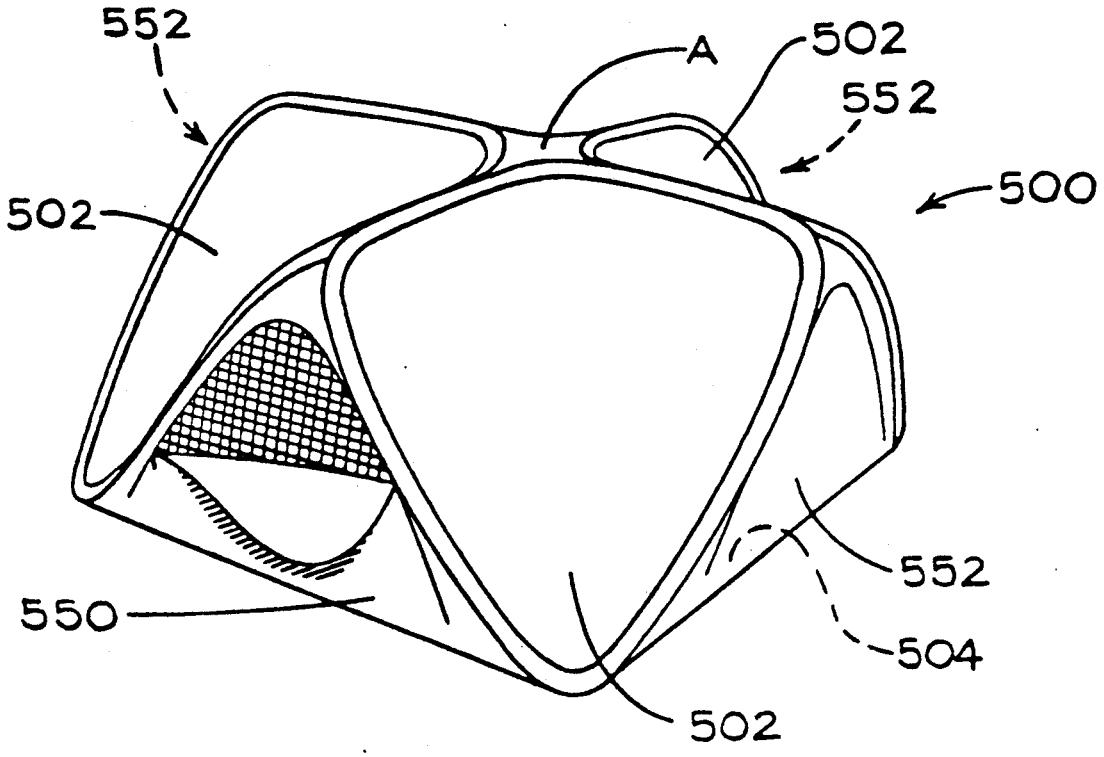
FIG. 26 is a top, front and right side perspective view of a fifth embodiment of the portable structure of this invention with four side members, a front door panel and side fill panels.

FIG. 26 is still another embodiment of this invention, generally designated by numeral 500, similar to embodiments 100 and 200 but with the addition of doorway panel 550 and three fill panels 552, preferably sewn to side members 502 and optional floor member 504, which cause the structure to become more enclosed. If embodiment 500 is to be used as a screen house, floor member 504 is omitted, however, the structure will nonetheless be self supporting even without floor member 504 because of the inclusion of panels 550 and 552 which act in a manner similar to straps 132 of embodiment 100.

Figure 27:
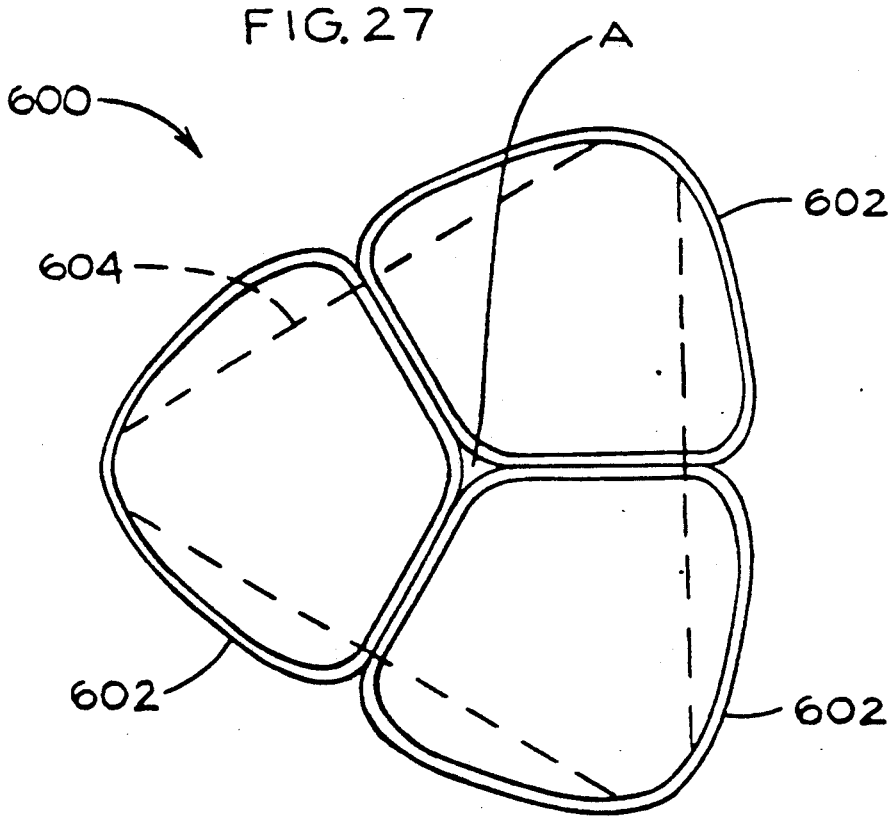
FIG. 27 is a top plan view of a sixth embodiment of the portable structure of this invention with three side members.

Portable structures having an odd number of side members can also be produced by the principals of this invention. FIGS. 27 and 28 are top plan views of a three sided and a five sided portable structure, generally designated by numerals 600 and 700, respectively, with side members 602 and 702, and floor members 604 (optional) and 704, respectively. Floor member 604 is optional and may be deleted from embodiment 600 and the structure will still be self supporting because of the shape of the three side members and the fact that there are but three side members. Structures with an odd number of side members require one of the hinge means to be operable for unhinging prior to collapse in order to form a stack of side members as is required in the first stage of collapse. FIG. 29 is a hinge means between adjacent side members having means 750 for quick connecting of the top parts of adjacent side members. Non-limiting examples of means 750 are zippers and "Velcro" type connectors having strips of hooks and eyes which adhere when pressed together. Although means 750 for quick connecting of adjacent side members may be employed for all embodiments, it should be understood that means 750 is optional for structures having an even number of side members, and that means 750 is required only on one pair of adjacent side members for structures having an odd number of side members.

Figure 30:
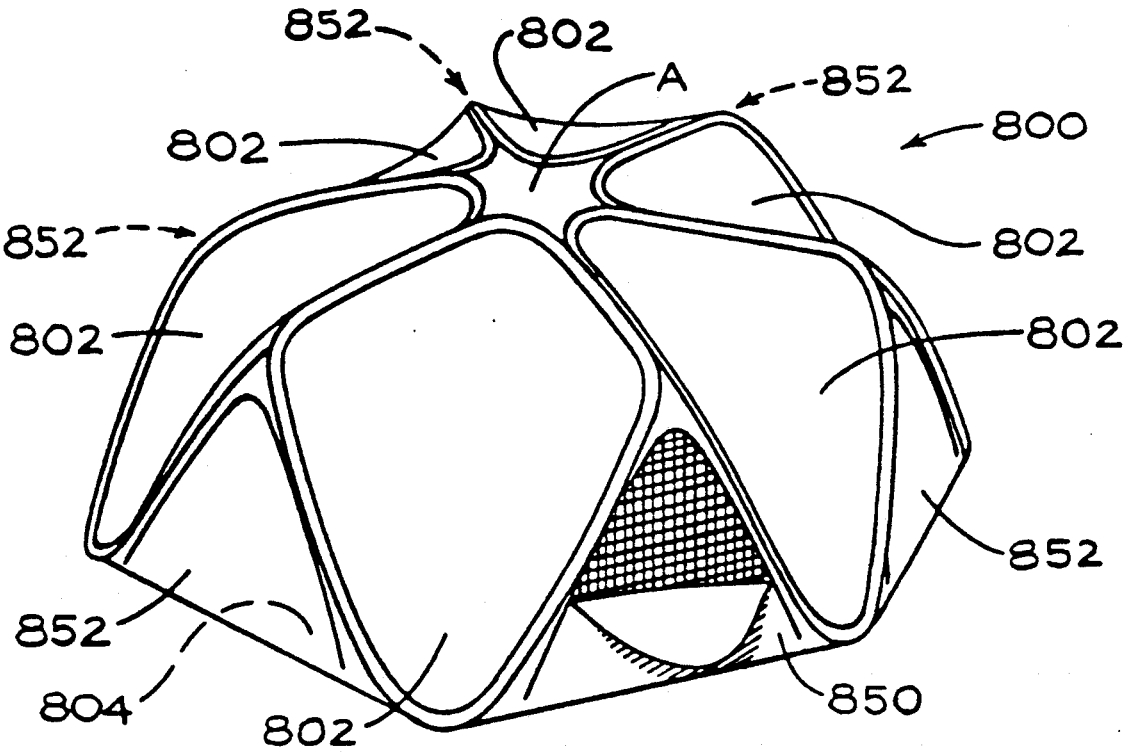
FIG. 30 is a top, front and left side perspective view of an eighth embodiment of the portable structure of this invention with five side members, a front door panel and side fill panels.

FIG. 30 is still another embodiment of this invention, generally designated by numeral 800, similar to embodiment 500 but with five side members. This embodiment has doorway panel 850 and four fill panels 852, preferably sewn to side members 802 and optional floor member 804. If embodiment 800 is to be used as a screen house, floor member 804 is omitted, however, the structure will nonetheless be self supporting even without floor member 804 because of the inclusion of panels 850 and 852 which act in a manner similar to straps 132 of embodiment 100. Since this is a structure having an odd number of side members means 750 must be provided and the fill or door panel proximate to means 750 must also be separable.

Figure 31:
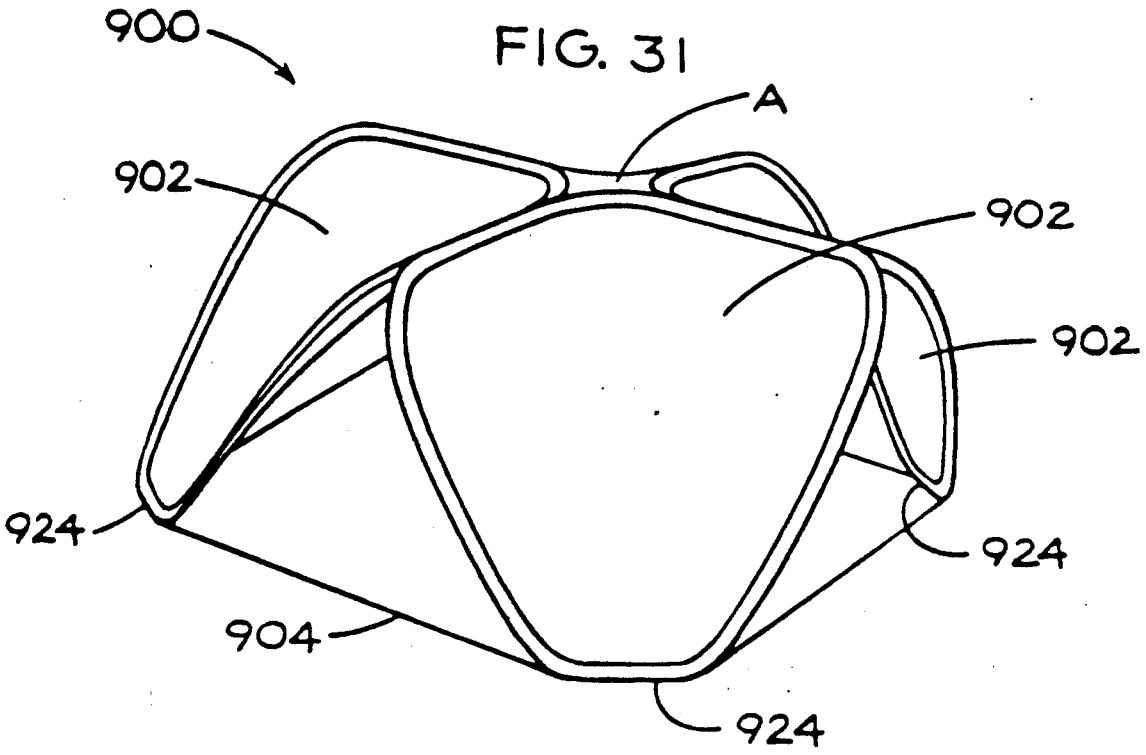
FIG. 31 is a top, front and right side perspective view of a ninth embodiment of the portable structure of this invention with four side members each side member having a flatten bottom part.

FIG. 31 is still another embodiment of this invention, generally designated by numeral 900, similar to embodiments 100 and 200 but with flatten bottom parts 924 on side members 902 to which floor member 904 is sewn.

In general, regardless of the number of side members, the complete collapsing sequence comprises folding the side members into a stack then an coiling the stack into three overlaying loops.

The apex, "A", of the upstanding portable structures can be left open, or closed by making the side members abut at the apex, or fitted with an apex panel sewn to the top part of the side members, or fitted with a rain bonnet.

While the preferred embodiments of the present invention have been described, it should be understood that various changes, adaptations and modifications may be made thereto without departing from the spirit of the invention and the scope of the appended claims. It should be understood, therefore, that the invention is not to be limited to minor details of the illustrated invention shown in preferred embodiment and the figures and that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

INDUSTRIAL APPLICABILITY

The portable structures of this invention are useful as tents, shelters, pavilions and automobile carports.

What I claim is:

1. A portable structure operable for transforming from a fully collapsible configuration into an upstanding fully expanded configuration and thence back into the fully collapsible configuration comprising:

a set of at least three side members each having:

an independent continuous frame formed from a flexible coilable material, the frame forming a single loop when expanded, and three overlaying loops when collapsed;

a side panel formed from a foldable material;

first means for confining the frame, the first means having a top left part and a top right part; and second means for attaching the side panel to the first means, whereby when the frame is expanded the side panel is pulled taut by the frame;

third means for hinging a portion of the top right part of the first means of one side member to a portion of the top left part of the first means of one other side member, thereby forming when the portable structure is in its fully expanded configuration a ring of side members each hinged at the top left part to another side member and at the top right part to yet another side member; and fourth means for holding the portable structure in the upstanding fully expanded configuration.

2. The portable structure of claim 1, wherein the first means is additionally for allowing the frame to slide in the first means.

3. The portable structure of claim 1, wherein the first means is a pocket formed from a foldable material.

4. The portable structure of claim 1, wherein the second means is stitching.

5. The portable structure of claim 1, wherein the third means is stitching.

6. The portable structure of claim 1, wherein the third means remains hinged during transforming from the fully collapsible configuration into the upstanding fully expanded configuration and thence back into the fully collapsible configuration.

7. The portable structure of claim 1, wherein the number of side members is an even number.

8. The portable structure of claim 1, wherein the number of side members is 4.

9. The portable structure of claim 1, wherein the number of side members is 6.

10. The portable structure of claim 1, wherein the number of side members is 8.

11. The portable structure of claim 1, wherein the third means can be unhinged for one pair of adjacent side members.

12. The portable structure of claim 1, wherein the number of side members is an odd number.

13. The portable structure of claim 1, wherein the number of side members is 3.

14. The portable structure of claim 1, wherein the number of side members is 5.

15. The portable structure of claim 1, wherein each side member has a bottom part intended for resting on a horizontal surface when the portable structure is fully expanded, and wherein the fourth means is for maintaining the bottom part of the side members in a predetermined horizontal spatial orientation.

16. The portable structure of claim 15, wherein the fourth means includes a floor panel member formed from a foldable material, and wherein the bottom part of each of the side members is connected to the floor panel member.

17. The portable structure of claim 1, wherein the frame of the side member is self expandable, wherein the third means is operable for folding the side members over each other thereby forming a stack of overlaying side members, and wherein the flexible coilable material of the frame is operable for simultaneously coiling the stack into three overlaying loops.

18. The portable structure of claim 1, wherein the third means is for permitting folding of each side member over another side member of the set of side members while hinged together.

19. A portable structure operable for transforming from a fully collapsible configuration into an upstanding fully expanded configuration and thence back into the fully collapsible configuration comprising:

a set of at least three side members each having:

an independent continuous self expandable frame formed from a flexible coilable material, the frame forming a single loop when expanded, and three overlaying loops when collapsed;

a side panel formed from a foldable material;

first means for confining the frame and allowing the frame to slide in the first means, the first means having a top left part and a top right part; and second means for attaching the side panel to the first means, whereby when the frame is expanded the side panel is pulled taut by the frame;

third means for hinging a portion of the top right part of the first means of one side member to a portion of the top left part of the first means of one other side member, thereby forming when the portable structure is in its fully expanded configuration a ring of side members each hinged at the top left part to another side member and at the top right part to yet another side member, the third means additionally for permitting folding of each side member over another side member of the set of the side members while the side members are hinged together thereby forming a stack of overlaying side members; and fourth means for restraining each side member, for stabilizing the portable structure and for maintaining it in the upstanding fully expanded configuration, wherein the flexible coilable material of the frame of the side members is operable simultaneously coiling the stack of overlaying side members into three overlaying loops thereby enabling the portable structure to be fully collapsed.

20. A portable structure operable for transforming from a fully collapsible configuration into an upstanding fully expanded configuration and thence back into the fully collapsible configuration comprising:

a set of at least three side members each having:

an independent continuous self expandable frame formed from a flexible coilable material, the frame forming a single loop when expanded, and three overlaying loops when collapsed;

a side panel formed from a foldable material;

first means for confining the frame and allowing the frame to slide in the first means, the first means having a top left part and a top right part, the first means including a pocket formed from a foldable material; and second means for attaching the side panel to the first means, the second means including stitching, whereby when the frame is expanded the side panel is pulled taut by the frame;

third means for hinging a portion of the top right part of the first means of one side member to a portion of the top left part of the first means of one other side member, the third means including stitching, thereby forming when the portable structure is in its fully expanded configuration a ring of side members each hinged at the top left part to another side member and at the top right part to yet another side member, the third means additionally for permitting folding of each side member over another side member of the set of side members while the side members are hinged together thereby forming a stack of overlaying side members; and fourth means for restraining each side member, for stabilizing the portable structure and for maintaining it in the upstanding fully expanded configuration, wherein each side member has a bottom part intended for resting on a horizontal surface when the portable structure is fully expanded, and wherein the fourth means is additionally for maintaining the bottom part of the side members in a predetermined horizontal separation orientation, wherein the fourth means includes a floor panel member formed from a foldable material, and wherein the bottom part of each of the side members is connected by stitching to the floor panel member, wherein the flexible coilable material of the frame of the side members is operable simultaneously coiling the stack of overlaying side members into three overlaying loops thereby enabling the portable structure to be fully collapsed.

21. The portable structure of claim 20, wherein the third means remains hinged during transforming from the fully collapsible configuration into the upstanding fully expanded configuration and thence back into the fully collapsible configuration, and wherein the number of side members is an even number.

22. The portable structure of claim 20, wherein the third means can be unhinged for one pair of adjacent side members, and wherein the number of side members is an odd number.

* * * * *